US009129762B2

(12) United States Patent
Ohtaka et al.

(10) Patent No.: US 9,129,762 B2
(45) Date of Patent: Sep. 8, 2015

(54) PUSH SWITCH

(71) Applicants: Seigo Ohtaka, Tokyo (JP); Shigemi Kawaguchi, Tokyo (JP)

(72) Inventors: Seigo Ohtaka, Tokyo (JP); Shigemi Kawaguchi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 246 days.

(21) Appl. No.: 13/677,531

(22) Filed: Nov. 15, 2012

(65) Prior Publication Data

US 2013/0134027 A1 May 30, 2013

(30) Foreign Application Priority Data

Nov. 25, 2011 (JP) ..... 2011-256999

(51) Int. Cl.
*H01H 13/52* (2006.01)
*H01H 13/14* (2006.01)

(52) U.S. Cl.
CPC ..... *H01H 13/14* (2013.01)

(58) Field of Classification Search
CPC ..... H01H 13/02; H01H 13/12; H01H 13/14; H01H 13/50; H01H 13/52
USPC ..... 200/531, 533, 516, 292, 406, 534, 535
See application file for complete search history.

(56) References Cited

U.S. PATENT DOCUMENTS

| | | | | |
|---|---|---|---|---|
| 7,525,059 | B2 * | 4/2009 | Masuda et al. | 200/406 |
| 8,115,130 | B2 * | 2/2012 | Kikuchi et al. | 200/406 |
| 2003/0213686 | A1 | 11/2003 | Takeuchi et al. | |
| 2009/0266698 | A1 * | 10/2009 | Kikuchi et al. | 200/341 |
| 2010/0230267 | A1 * | 9/2010 | Masuda et al. | 200/520 |

FOREIGN PATENT DOCUMENTS

| | | | |
|---|---|---|---|
| CN | 1366690 | A | 8/2002 |
| CN | 101567277 | A | 10/2009 |
| JP | 2003-297175 | | 10/2003 |
| JP | 4557043 | | 7/2010 |
| JP | 2010-212172 | | 9/2010 |
| JP | 56-37321 | | 12/2014 |

OTHER PUBLICATIONS

China Patent Office; Office Action Issued Jul. 25, 2014.
Japan Patent Office; Office Action issued Oct. 22, 2013.

* cited by examiner

*Primary Examiner* — Amy Cohen Johnson
*Assistant Examiner* — Marina Fishman
(74) *Attorney, Agent, or Firm* — Whitham, Curtis, Christofferson & Cook, P.C.

(57) ABSTRACT

There is provided a push switch including an insulating case, a conductive member, a movable electrode and an operating member. The insulating case has a wall portion defining a recess. The conductive member has a first portion embedded into the wall portion and a second portion disposed in the recess as a fixed electrode. The movable electrode is disposed in the recess and is displaced between a first position and a second position. The operating member is moved to displace the movable electrode from the second position to the first position. An anchor member protrudes from the conductive member in a direction not parallel to the direction in which the operating member is moved, and embedded into the wall portion.

9 Claims, 6 Drawing Sheets

PUSH SWITCH

BACKGROUND

The invention relates to a switch used in various small electronic equipment, and more particularly, to a push switch which is mounted on a circuit board and includes an operating member adapted to be displaced in a direction parallel to the circuit board.

In such push switches, a resin case mounted on a circuit board has a recess formed therein. A conductive member is integrally provided in the case by insert molding and the like, and a part of the conductive member is disposed as a fixed electrode inside the recess. A movable electrode is additionally disposed inside the recess to be elastically displaced between a first position in which the moveable electrode is contacted with the fixed electrode and a second position in which the movable electrode is spaced apart from the fixed electrode.

The push switches are provided with an operating member. When a user presses the operating member in a state in which the switch is mounted on the circuit board, the operating member is moved in a direction parallel to the circuit board so that the movable electrode is displaced to the first position, and thus is electrically conductively connected with the fixed electrode. If the pressing force is removed, the moveable electrode is elastically returned to the second position, thereby canceling the electrically conductive state between the movable electrode and the fixed electrode (e.g., see Patent Document 1).

[Patent Document 1] Japanese Patent No. 4557043

In switches as described above, the pressing force exerted to move the operating member in the direction parallel to the circuit board, causes a component force in a direction parallel to the circuit board and a component force in a direction away from the circuit board, thereby acting to detach a part of the case from the conductive member. As the switches are downsized accompanying with downsizing in recent electronic equipment, the pressing force exerted by a user becomes higher relative to the structural strength of the switches. If the pressing force exceeds the structural strength of the switches, a part of the case is often broken and detached from the conductive member.

SUMMARY

It is therefore one advantageous aspect of the present invention to provide thin connector a push switch which can satisfy demands for downsizing and also enhance durability against a pressing force of an operating member.

According to one aspect of the invention, there is provided a push switch configured to be mounted on a circuit board, comprising:

an insulating case, having a wall portion defining a recess;

a conductive member, having a first portion embedded into the wall portion and a second portion disposed in the recess as a fixed electrode;

a movable electrode, disposed in the recess, and configured to be displaced between a first position in which the moveable electrode is contacted with the fixed electrode and a second position in which the movable electrode is spaced apart from the fixed electrode;

an operating member, configured to be moved in a direction parallel to the circuit board by a pressing force exerted thereon in a state in which the push switch is mounted on the circuit board, and to displace the movable electrode from the second position to the first position; and an anchor member, protruding from the conductive member in a direction not parallel to the direction in which the operating member is moved, and embedded into the wall portion.

The anchor member may include a first anchor portion having a first width dimension and a second anchor portion having a second width dimension greater than the first width dimension.

The first anchor portion may be located closer to the conductive member than the second anchor portion is.

The anchor member may form an integral structure with the first portion.

The anchor member may protrude from a side edge of the first portion.

The anchor member may form an integral structure with the second portion.

The anchor member may protrude from a side edge of the second portion.

The anchor member may be provided on a section of the conductive member extended parallel to the circuit board in a state where the push switch is mounted on the circuit board.

The conductive member may comprise a third portion exposed on a side surface of the case.

The conductive member may comprise a third portion exposed on a surface of the case facing the circuit board.

DETAILED DESCRIPTION OF EXEMPLIFIED EMBODIMENTS

Figure 1:
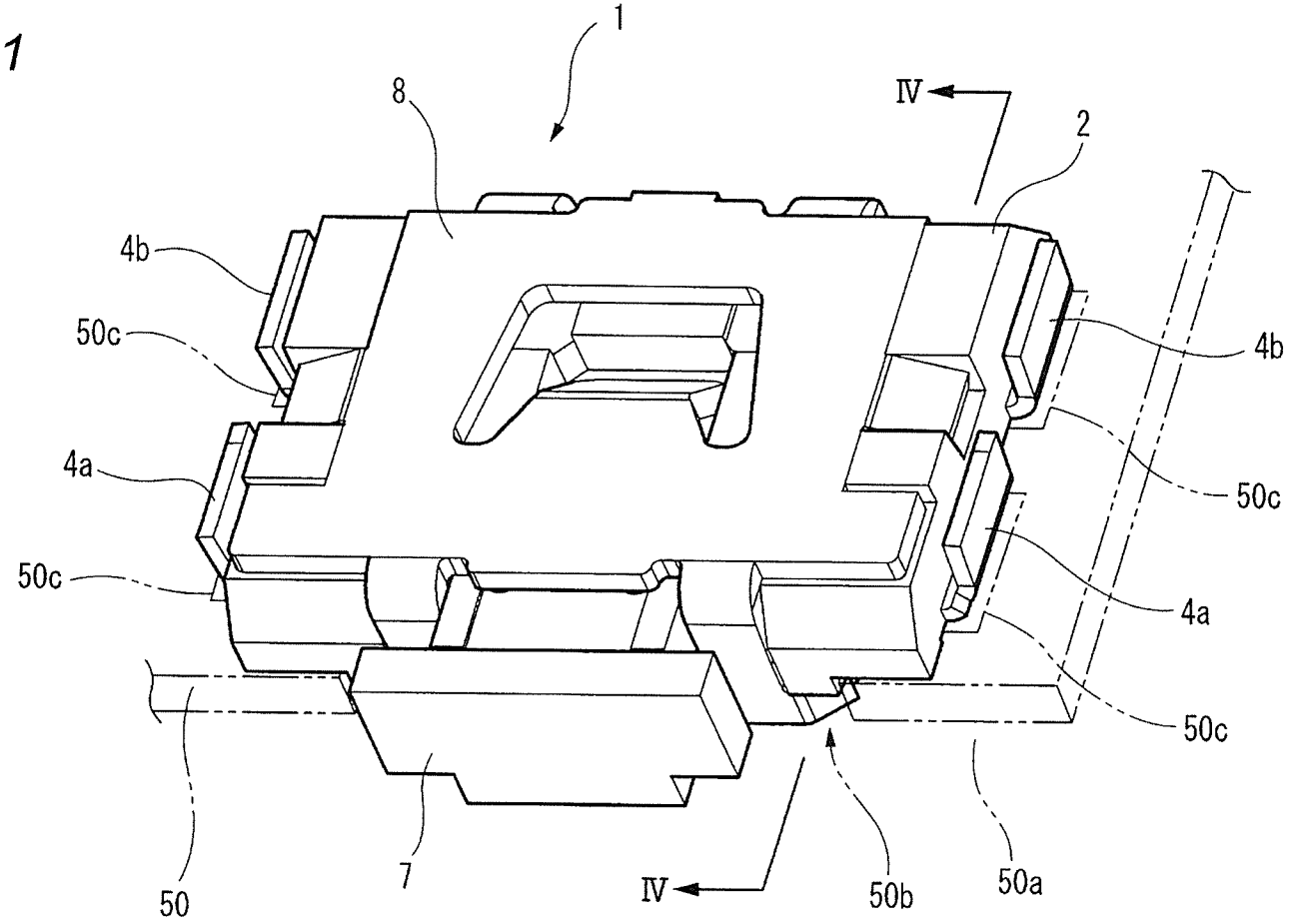
FIG. 1 is a perspective view showing the exterior of a push switch according to an embodiment of the present invention.

Embodiments according to the present invention will be now described in detail with reference to the accompanying drawings. In the drawings referred in the following description, the scale of each element is appropriately adjusted to easily recognize the size of each element.

FIG. 1 is a perspective view showing the exterior of a push switch 1 according to an embodiment of the present invention. The push switch 1 includes a case 2 mounted on a circuit board 50. A cover 8 is installed on a top side of the case 2 and an operating member 7 is provided on a front side of the case 2. The operating member 7 is configured to be displaced in a front-rear direction in response to a pressing operation by a user.

A first outer connecting terminal 4*a* and a second outer connecting terminal 4*b* are provided on each of left and right sides of the case 2. Each of the first outer connecting terminal 4*a* and the second outer connecting terminal 4*b* is connected and fixed to a respective land portion 50*c* of a wiring terminal formed on a mounting surface of the circuit board 50 by soldering. In the following description, the first outer connecting terminal 4*a* and the second outer connecting terminal 40*b* will be called collectively as the 'outer connecting terminal,' as necessary.

Figure 2D:
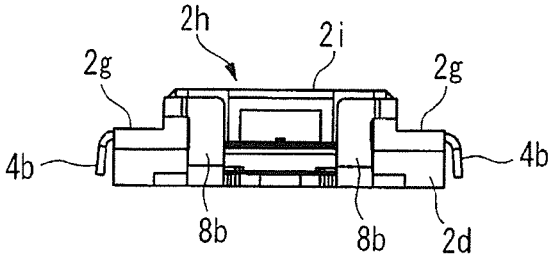
FIG. 2D is a rear view showing the exterior of the push switch of FIG. 1.
Figure 2A:
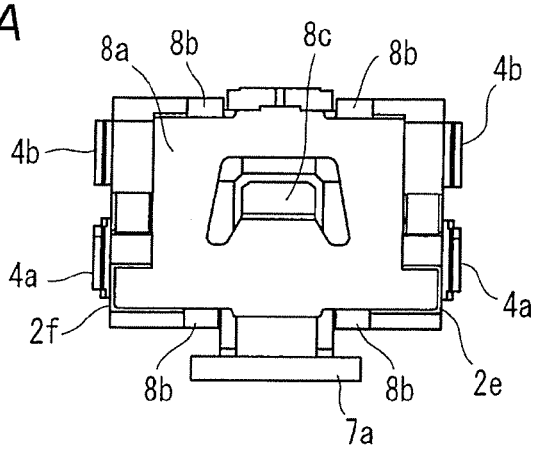
FIG. 2A is a top view showing the exterior switch of FIG. 1.
Figure 2E:
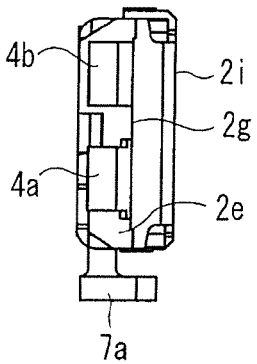
FIG. 2E is a right side view showing the exterior of the push switch of FIG. 1.
Figure 2B:
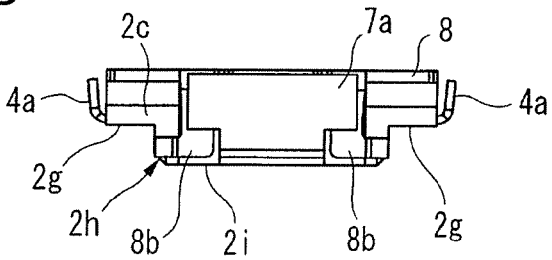
FIG. 2B is a front view showing the exterior of the push switch of FIG. 1.
Figure 2C:
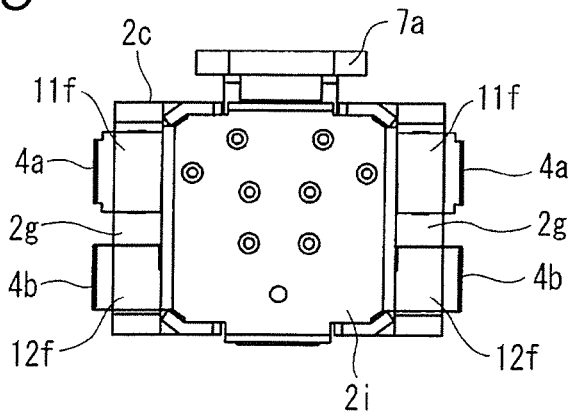
FIG. 2C is a bottom view showing the exterior of the push switch of FIG. 1.
Figure 3:
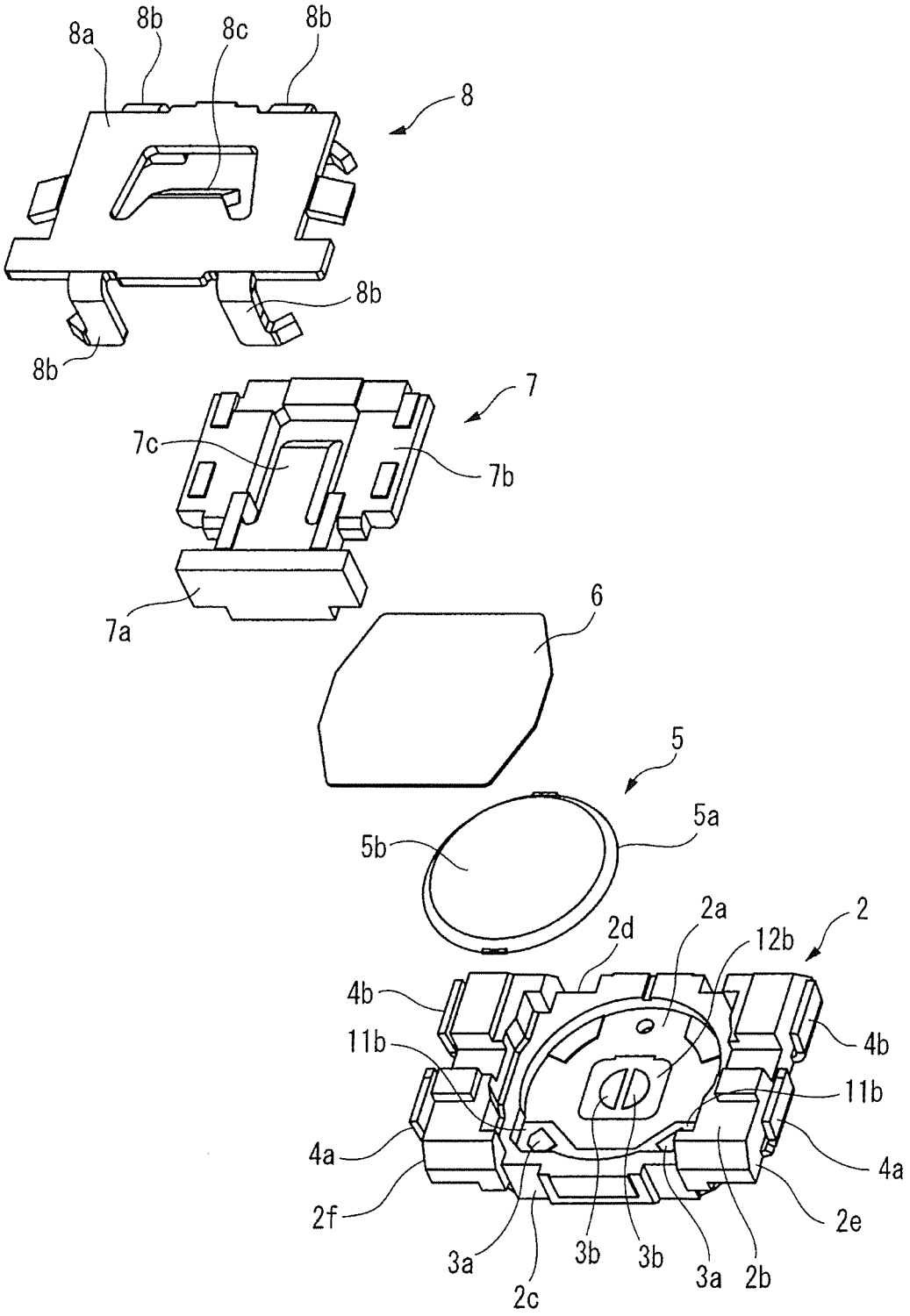
FIG. 3 is an exploded perspective view showing the internal configuration of the push switch of the FIG. 1.

FIGS. 2A to 2E are five-side views showing the exterior of the push switch 1 of FIG. 1, and FIG. 3 is an exploded perspective view showing the internal configuration of the push switch 1. FIG. 2A is a top view, FIG. 2B is a front view, FIG. 2C is a bottom view, FIG. 2D is a rear view and FIG. 2E is a right side view. The shape when viewed from the left side is symmetric to that shown in the right side view, and accordingly the illustration thereof is omitted.

The case 2 is made of an insulating material, such as a resin, and has a recess 2*a* defined to be opened upward by a wall portion. A plurality of first fixed electrodes 3*a* are disposed on a perimeter edge of a bottom portion of the recess 2*a* and a plurality of second fixed electrodes 3*b* are disposed in the center of the bottom portion.

A movable electrode 5 is an elastically deformable and dome-shaped conductive member. The movable electrode 5 is received and disposed in the recess 2*a* such that an outer edge 5*a* thereof is contacted with the first fixed electrodes 3*a* and a central portion 5*b* is spaced from and opposed to the second fixed electrodes 3*b*. In other words, the movable electrode 5 takes a shape bulged upward in a normal state.

A protection member 6 made of an insulating resin sheet material, such as a polyamide resin is placed on a top surface 2*b* of the case 2 to cover the recess 2*a* and is fixed by an adhesive. The protection member 6 prevents foreign substances from invading into the recess 2*a* and also is interposed between an operating member 7, as described below, and the movable electrode 5, thereby performing as a cushioning material.

The operating member 7 is made of a resin material and the like and includes a pressing portion 7*a*, a supporting portion 7*b*, and an operating portion 7*c*. The operating member 7 is placed on the protection member 6.

A cover 8, which is formed by punching and bending a metal sheet, includes a main body 8*a* placed on the top surface 2*b* of the case 2 and four engaging legs 8*b* extending downward from front and rear edges of the main body 8*a*. A portion of the middle of the main body 8*a* is cut out to form a guide piece 8*c* obliquely downwardly extending rearward.

The engaging legs 8*b* are engaged at predetermined locations of a front surface 2*c* and a rear surface 2*d* of the case 2, so that the cover 8 is mounted on the case 2 and the supporting portion 7*b* and the operating portion 7*c* of the operating member 7 are held movably in a front-rear direction between the main body 8*a* of the cover 8 and the protection member 6. The pressing portion 7*a* of the operating member 7 is protruded forward relative to the front surface 2*c* of the case 2.

As shown in FIG. 2, left and right sides of a lower portion of the case 2 constitute board facing surfaces 2*g*. A region located between the board facing surfaces 2*g* constitutes a board inserting portion 2*h* protruding downward. As shown in FIG. 1, the board inserting portion 2*h* is inserted into a notch 50*b* formed in an end surface 50*a* of the circuit board 50 and a bottom surface 2*i* thereof is located at side of a lower surface of the circuit board 50.

In this state, the board facing surfaces 2*g* face an upper surface of the circuit board 50 with a slight gap interposed therebetween. Each of the first outer connecting terminal 4*a* and the second outer connecting terminal 4*b* faces the respective land portion 50*c* of the wiring terminal formed on the mounting surface of the circuit board 50 with a slight gap interposed therebetween. A solder is flowed into the gap, so that each of the first outer connecting terminal 4*a* and the second outer connecting terminal 4*b* is connected and fixed to the respective land portion 50*c*.

Figure 4A:
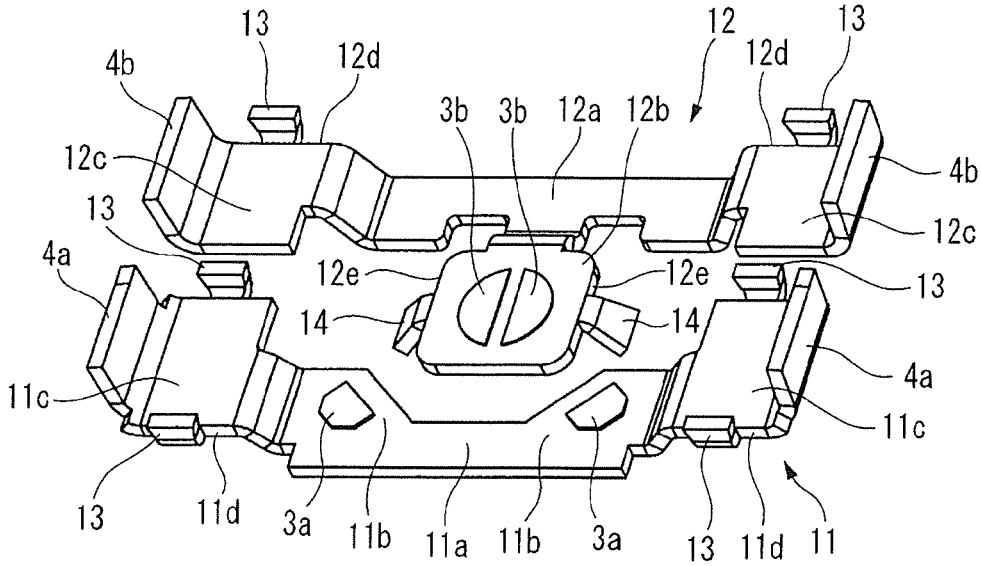
FIG. 4A is a perspective view showing a shape of conductive members in the push switch of the FIG. 1.

FIG. 4A is a perspective view showing the exterior of a first conductive member 11 and second conductive member 12 for forming an electrically conductive path of the push switch 1. In the following description, the first conductive member 11 and the second conductive member 12 will be called collectively as the 'conductive member,' as necessary.

The conductive members are formed by punching and bending a metal sheet and also integrally molded in the case 2 by insert molding and the like, so that a portion thereof is embedded into the case 2. Specifically, the conductive members include a first portion embedded into the wall portion defining the recess 2*a* of the case, and a second portion disposed inside the recess 2*a* of the case 2, and a third portion exposed to the outside of the case 2.

The first conductive member 11 extends in a left-right direction and the first fixed electrodes 3*a* are provided on both left and right sides of a central portion 11*a* thereof. Also, both left and right ends of the first conductive member 11 are bended upward to constitute the first outer connecting terminals 4*a*. As shown in FIG. 3, a portion 11*b* (an electrode forming portion 11*b*) in which the first fixed electrodes 3*a* are included, is disposed inside the recess 2*a* of the case 2, and the first outer connecting terminals 4*a* are exposed on left and right side surfaces 2*e* and 2*f* of the case 2 to the outside of the case 2. The electrode forming portion 11*b* corresponds to the second portion of the first conductive member 11, and the first outer connecting terminals 4*a* correspond to the third portion of the first conductive member 11. Besides these portions, a portion 11*c* is embedded into the wall portion defining the recess 2*a*. The embedded portion 11*c* corresponds to the first portion of the first conductive member 11. In other words, the first fixed electrodes 3*a* and the first outer connecting terminals 4*a* are electrically conductively connected with each other via the embedded portion 11*c*.

The second conductive member 12 is formed in a T-shape, and a front end 12*b* (an electrode forming portion 12*b*) of a section thereof extending forward relative to a central portion 12*a* of a section thereof extending in a left-right direction is provided with the second fixed electrodes 3*b*. Both ends of the section extending in a left-right direction are bended upward to constitute the second outer connecting terminals 4*b*.

As shown in FIG. 3, the portion 12*b* in which the first fixed electrodes 3*b* are included, is disposed inside the recess 2*a* of the case 2, and the second outer connecting terminals 4*b* are exposed on left and right side surfaces 2*e* and 2*f* of the case 2 to the outside of the case 2. The portion 12*b* corresponds to the second portion of the second conductive member 12, and the second outer connecting terminals 4*b* correspond to the third portion of the second conductive member 12. Besides these portions, a portion 12*c* is embedded into the wall portion defining the recess 2*a*. The embedded portion 12*c* corresponds to the first portion of the second conductive member 12. In other words, the second fixed electrodes 3*b* and the second outer connecting terminals 4*b* are electrically conductively connected with each other via the embedded portion 12*c*.

Figure 4B:
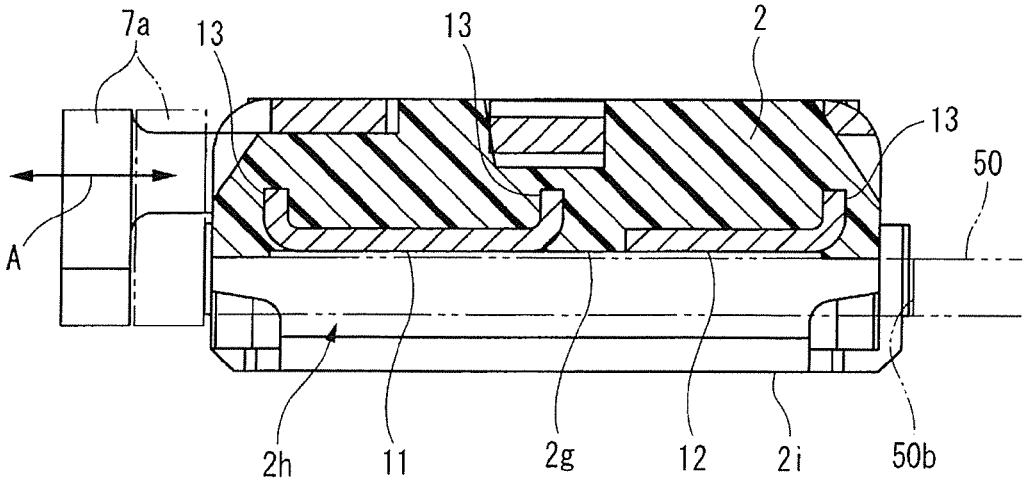
FIG. 4B is a sectional view taken along a line IV-IV in FIG. 1.

As shown in FIG. 4B, when a user indirectly or directly presses the pressing portion 7*a* of the operating member 7 rearward, the supporting portion 7*b* and the operating portion 7*c* are slid rearward beneath the cover 8. If the operating portion 7 is moved rearward by a predetermined amount, the operating portion 7 is abutted against a lower surface of the guide piece 8*c* of the cover 8. Because the guide piece 8*c* is obliquely downwardly inclined, the operating portion 7*c* of the operating member 7 is downwardly guided to press the movable electrode 5 via the protection member 6.

If a load exerted on the movable electrode 5 exceeds a predetermined value, the central portion 5*b* is inverted to become a downward convexed state while accompanying a clicking feel, and also contacted to the second fixed electrodes 3*b*. Therefore, the first fixed electrodes 3*a* and the second fixed electrodes 3*b* are electrically conductively connected with each other via the movable electrode 5. Accordingly, for each of the first fixed electrodes 3*a* and the second electrodes 3*b*, at least one electrode may be provided.

If the pressing force is removed, the central portion 5*b* is returned to an initial state (i.e., an upward convexed state) by a self-restoration force (elasticity) of the movable electrode 5 while accompanying a clicking feel, and the electrically conductive state between the first fixed electrodes 3*a* and the second fixed electrodes 3*b* is cancelled. The operating portion 7*c* of the operating member 7 is obliquely upwardly guided by the guide piece 8*c* of the cover 8, so that the supporting portion 7*b* is slid forward and the pressing portion 7*a* is returned to an initial position.

Specifically, the movable electrode 5 can be displaced between a first position in which the moveable electrode 5 is contacted with the second fixed electrodes 3*b* and a second position in which the movable electrode 5 is spaced apart from the second fixed electrodes 3*b*. The operating member 7 is moved in a direction parallel to the circuit board 50 by a pressing force exerted thereon from the outside in a state in which the push switch 1 is mounted on the circuit board 50, so that the movable electrode 5 is moved from the second position to the first position.

The operating force for pressing the operating member 7 causes a component force in a direction parallel to the circuit board 50 and a component force in a direction away from the circuit board 50, thereby acting to detach a part of the case 2 from the conductive members. Accordingly, the push switch 1 of the embodiment includes anchor members 13, as shown in FIG. 4B, which protrude from the conductive members in a direction not parallel to a moving direction A of the operating member 7 and are embedded into the wall portion defining the recess 2*a* of the case 2. The anchor members 13 can prevent a part of the case 2 from being detached from the conductive members, in particular by the component force in the direction parallel to the circuit board 50.

As shown in FIGS. 4A and 4B, the first conductive member 11 has a plurality of anchor members 13. Each of the anchor members 13 protrudes upward from a side edge 11*d* of the embedded portion 11*c*. Each of the anchor members 13 forms an integral structure with the embedded portion 11*c*, and thus, together with the first conductive member 11, is easily formed by punching and bending a metal sheet.

The second conductive member 12 also has a plurality of anchor members 13. Each of the anchor members 13 protrudes upward from a side edge 12*d* of the embedded portion 12*c*. Each of the anchor members 13 forms an integral structure with the embedded portion 12*c*, and thus, together with the second conductive member 12, is easily formed by punching and bending a metal sheet.

As used herein, the term 'integral structure' means that boundaries between the anchor members 13 and the embedded portions 11*c* and 12*c* are made of an identical material and are formed in a continuous state (i.e., a monolithic state). In the following description, the term is used to be distinguished from a configuration in which two or more members different in material or properties are integrally connected to each other by welding or bonding. Because the anchor members 13 and the embedded portions 11*c* and 12*c* are formed in the integral structure, a structure of a high strength can be obtained by an easy processing.

As each of the anchor members 13 is further extended upward, in other words, further spaced away from the embedded portions 11*c* and 12*b*, a width dimension of the anchor member 13 is increased. This can more effectively prevent a part of the case 2 from being detached from the conductive members, in particular by the component force in the direction away from the circuit board 50. The direction, in which the width dimension is increased, corresponds to a direction perpendicular to the moving direction of the operating member 7.

Figure 5A:
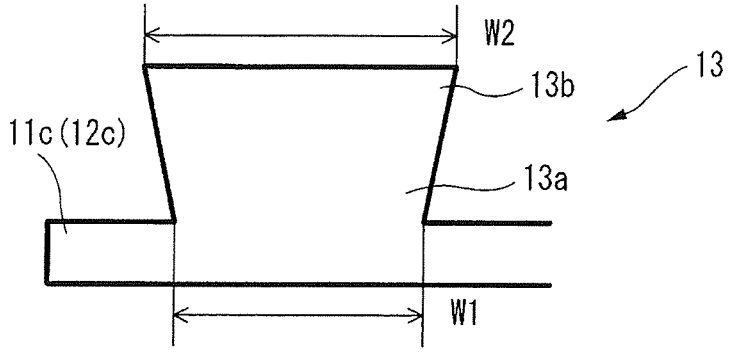
FIG. 5A shows the shape of an anchor member.

More particularly, as shown in FIG. 5A, each of the anchor members 13 includes a first anchor portion 13*a* having a first width dimension W1 and a second anchor portion 13*b* having a second width dimension W2 greater than the first width dimension W1. Because the first anchor portion 13*a* is located closer to the embedded portions 11*c* and 12*c* than the second anchor portion 13*b* is, it is possible to counter a stress in a direction separating a part of the case 2 from the conductive members.

Figure 5B:
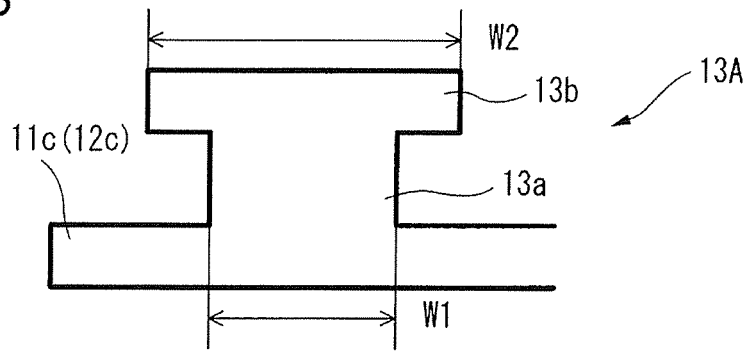
FIG. 5B is an alternative shape showing stepped side and end surfaces.

The anchor members 13 are not limited to the above shape having inclined side end surfaces. If the second anchor portion 13*b* being wider in width than the first anchor portion 13*a* is located further away from the embedded portions 11*c* and 12*c* than the second anchor portion 13*a* is, a shape having stepped side end surfaces, as in an anchor member 13A shown in FIG. 5B, may also be conceived.

Figure 5C:
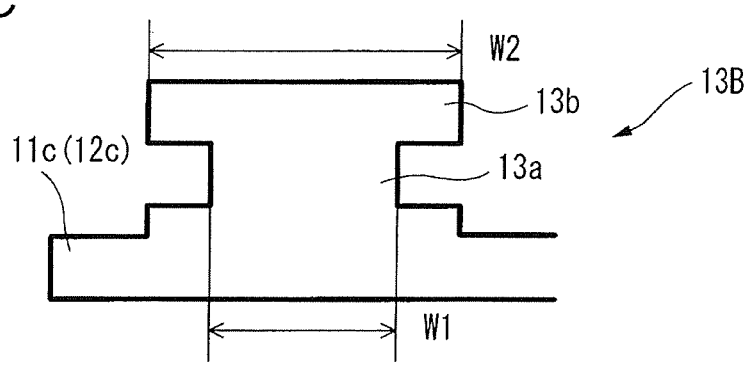
FIG. 5C shows the anchor of being wider in width.
Figure 5D:
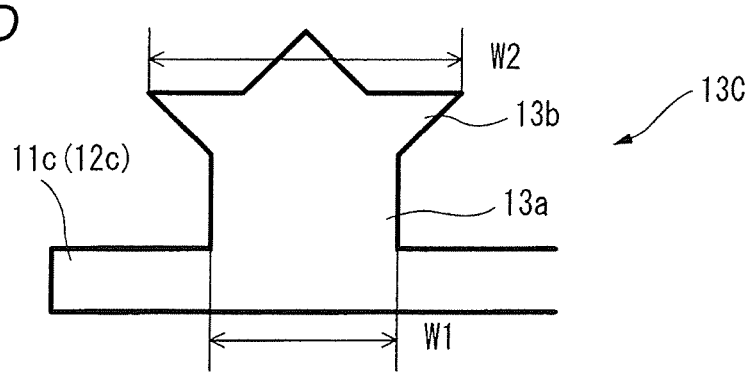
FIG. 5D shows the anchor being narrower in width.

Also, if the second anchor portion 13*b* being wider in width than the first anchor portion 13*a* is located further away from the embedded portions 11*c* and 12*c* than the first anchor portion 13*a* is, a portion being wider in width than the first anchor portion 13*a*, as in an anchor member 13B shown in FIG. 5C, may be provided closer to the embedded portions 11*c* and 12*c*. Furthermore, a portion being narrower in width than the second anchor portion 13*b*, as in an anchor member 13C shown in FIG. 5D, may be provided on a side further away from the embedded portions 11*c* and 12*c*.

Each of the anchor members 13 is provided on sections of the embedded portions 11*c* and 12*c* of the conductive members extended parallel to the circuit board 50, in a state in which the push switch 1 is mounted on the circuit board 50. As a result, the preventing effect as described above can be more enhanced.

Also, the push switch 1 of the embodiment includes anchor members 14, as shown in FIG. 4A, which protrude from the electrode forming portion 12*b* of the conductive members 12 in a direction not parallel to a moving direction of the operating member 7 and are embedded into the wall portion defining the recess 2*a* of the case 2. The anchor members 14 can prevent a part of the case 2 from being detached from the conductive member, in particular by the component force in the direction parallel to the circuit board 50.

The second conductive member 12 has a plurality of anchor members 14. Each of the anchor members 14 protrudes obliquely downward from a side edge 12*e* of the electrode forming portion 12*b*. Each of the anchor members 14 forms an integral structure with the electrode forming portion 12*b*, and thus, together with the second conductive member 12, is easily formed by punching and bending a metal sheet.

As each of the anchor members 14 is further extended downward, in other words, further spaced away from the electrode forming portion 12*b*, a width dimension of the anchor member 14 is increased. This can more effectively prevent a part of the case 2 from being detached from the conductive member, in particular by the component force in the direction away from the circuit board 50. The direction, in which the width dimension is increased, corresponds to a direction perpendicular to the moving direction of the operating member 7.

Each of the anchor members 14 is not limited to the shape as shown in FIG. 4A, but variants described with reference to FIGS. 5A to 5D, like the anchor member 13, may also be conceived.

Each of anchor members 14 is provided on a section of the electrode forming portion 12*b* extended parallel to the circuit board 50, in a state in which the push switch 1 is mounted on the circuit board 50. As a result, the preventing effect as described above can be more enhanced.

Figure 6:
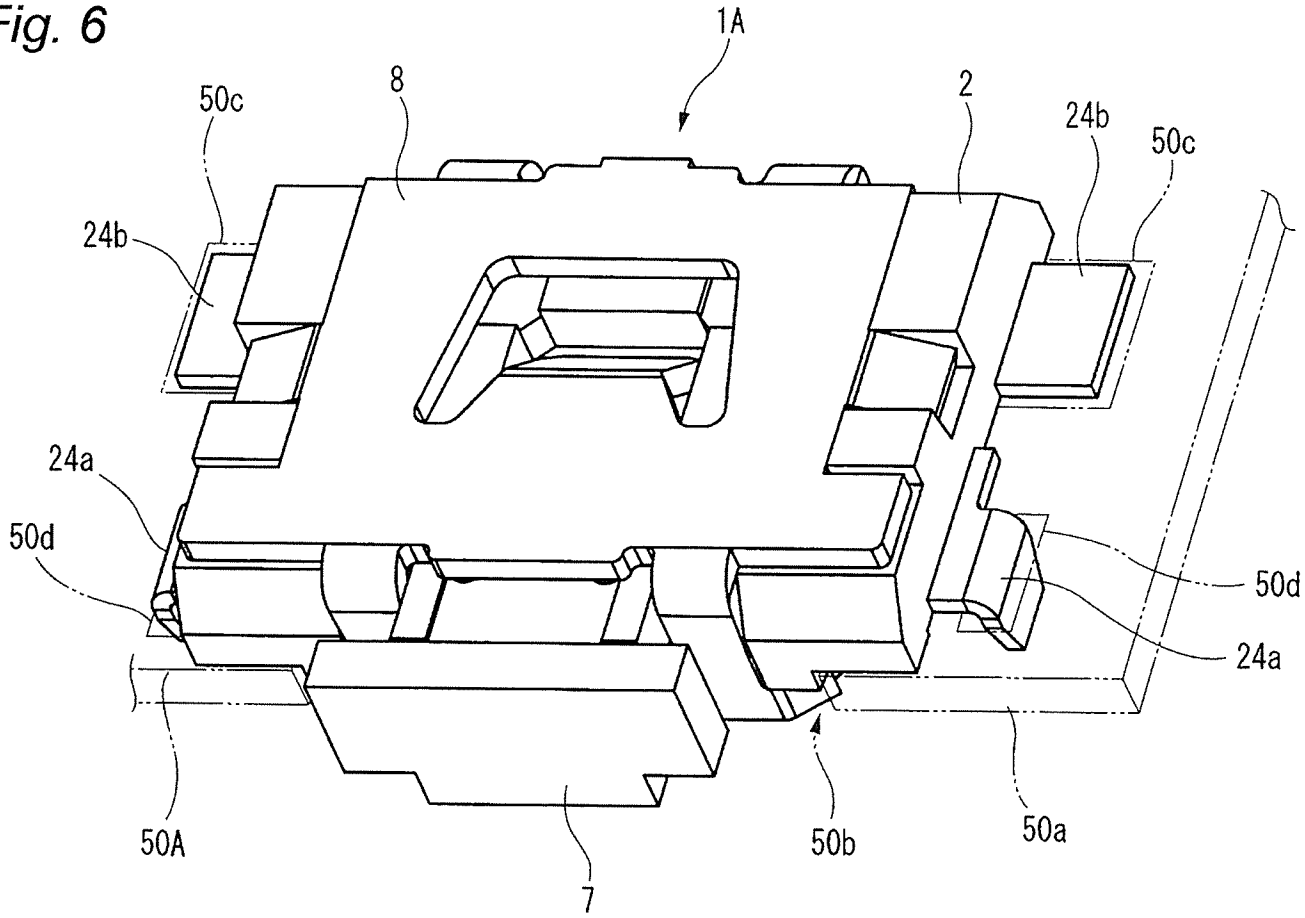
FIG. 6 is a perspective view showing the exterior of a variant of the push switch of FIG. 1.

Hereinafter, a push switch 1A according to a variant of the embodiment will be described with reference to FIG. 6. This variant is different from the foregoing embodiment in a shape of outer connecting terminals. The other configurations are identical to those of the foregoing embodiment, and accordingly the detailed description thereof is omitted.

A first outer connecting terminal 24*a* electrically conductively connected with the first fixed electrodes 3*a* via the first conductive member 11 is exposed on each of the left and right side surfaces 2*e* and 2*f* of the case 2 to the outside, and then is bended downward. Each of the first outer connecting terminals 24*a* is inserted into a respective through-hole 50*d* connected to a wiring terminal formed on a mounting surface of a circuit board 50A and then is fixed by soldering.

A second outer connecting terminal 24*b* electrically conductively connected with the second fixed electrodes 3*b* via the first conductive member 12 is exposed on each of the left and right side surfaces 2*e* and 2*f* of the case 2 to the outside, and then is not bended, but extended parallel to the mounting surface of the circuit board 50A. Each of the second outer connecting terminals 24*b* is connected to a respective land potion 50*c* of a wiring terminal formed on the mounting surface by soldering.

Like the second outer connecting terminals 24*b*, the first outer connecting terminals 24*a* may be extended parallel to the mounting surface of the circuit board 50A and connected to the land portion 50*c*. Also, the second outer connecting terminals 24*b*, like the first outer connecting terminals 24*a*, may be bended downward and inserted into the through-hole 50*d* of the circuit board 50A.

The foregoing embodiments are intended to facilitate the understanding of the present invention, but not to limit the invention. The present invention may be modified and altered without departing from the spirit and scope of the invention, and is intended to encompass equivalents thereof.

If a switching between an electrically conductive state and an electrically non-conductive state is obtained by movement of the operating member 7, the number, shape and arrangement of the conductive members are properly determined depending on design requirements, but not limited to the above configuration. The number, shape, protruding direction and arrangement of the anchor members 13 and 14 are properly determined depending on such requirements in the conductive members.

For example, in the foregoing embodiments, a main surface (i.e., a surface having the largest area) of the anchor members 13 extends in a direction perpendicular to the moving direction of the operating member 7, and a main surface of the anchor members 14 extends in a direction parallel to the moving direction of the operating member 7. However, depending on the shape or arrangement of the conductive members, the directions, in which the anchor members 13 and 14 are extended, may be coincided with any one of the direction described above, and also may be obliquely transverse to the moving direction of the operating member 7.

Also, for example, the anchor members 13 and 14 in the embodiments are provided on sections of the conductive members extended parallel to the circuit board 50. However, depending on the shape or arrangement of the conductive members, the anchor members 13 and 14 may be provided on sections of the conductive members extended in a direction not parallel to the circuit board 50.

In the embodiments, the anchor members 14 are provided on only the electrode forming portion 12*b* of the second conductive member 12. However, the anchor member 14 may be provided on the electrode forming portion 11*b* of the first conductive member 11.

It is not necessary that the anchor members 13 and 14 form the integral structure with the conductive members. Anchor members, which are formed separately, may be fixed on the conductive member by welding or bonding.

It is not necessary that the anchor members 13 and 14 protrude from side edges of the conductive members. Depending on the shape or arrangement of the wall portion of the case 2, in which the anchor members are embedded, the anchor members may be provided on an upper or lower surface of the embedded portions 11*c* and 12*c*, or on a lower surface of the electrode forming portion 11*b* and 12*b*.

As shown in FIG. 2C, the portion 11*f* of the first conductive member 11 and the portion 12*f* of the second conductive member 12 in the embodiments are exposed on the board facing surface 2*g* of the case 2. The land portions 50*c* of the circuit board 50 may be provided at locations facing any one side of the exposed portions 11*f* and 12*f*, and the portions may be connected and fixed thereto by soldering.

When portions of the conductive members are exposed on a surface of the case 2 facing the circuit board 50, and the portions are connected to circuit wiring by soldering, outer connecting terminals exposed on side surfaces of the case 2 can be omitted, thereby decreasing a mounting area.

In the embodiments, the board inserting portion 2*h* is inserted into the notch 50*b* formed in the circuit board 50 and thus the push switch 1 is fixed on the circuit board 50. However, it is not necessary to provide the board inserting portion 2*h*. Namely, the board facing surface 2*g* of the case 2 may be substantially formed as the bottom surface of the case 2.

Also, in this case, each of the outer connecting terminals can employ the respective shape as described above, and in addition, the outer connecting terminals may be omitted such that portions of the conductive members exposed on a surface of the case 2 facing the circuit board may be connected to circuit wiring.

In the foregoing description, it will be understood that various directional terms with respect to 'up and down,' 'left and right,' and 'front and rear' are used only for convenience in the description with reference to the accompanying drawings, and that no fixed directional limitations in use of the product are intended by the use of these words. The terms "upward" and "downward" can be respectively changed to the terms 'direction away from the circuit board' and a 'direction approaching to the circuit board.' Similarly, the terms 'front-rear direction' and 'left-right direction' can be also changed to the term 'direction parallel to the circuit board.'

In view of the above, according to the present invention, there can be prevented a part of the case from being detached from the conductive member, in particular by a component force in the direction parallel to the circuit board.

According the invention, there can be more effectively prevented a part of the case from being detached from the conductive member, in particular by a component force in the direction away from the circuit board.

According the invention, a structure of a high strength can be obtained by an easy processing, such as by punching a metal sheet.

Herein, the term 'integral structure' means that boundaries between the anchor member and the first and second portions are made of an identical material and boundaries therebetween are formed in a continuous state (i.e., a monolithic state). The term is used to be distinguished from a configuration in which two or more members different in material or properties are integrally connected to each other by welding or bonding.

If the anchor member protrudes from a side edge of at least one of the first portion and the second portions, the anchor member can be easily formed by formed by bending a metal sheet and the like.

When the anchor member are provided on a section of the conductive member extended parallel to the circuit board, in a state in which the push switch is mounted on the circuit board, the preventing effect as described above can be more enhanced.

According the invention, the third portion can be easily fixed on a mounting surface of the circuit surface by soldering and can be used as a connecting portion to circuit wiring.

When the third portion is used as a connecting portion to circuit wiring, a mounting area of the push switch can be decreased.

According to the present invention, there is provided a push switch which can satisfy demands for downsizing and also enhance durability against a pressing force of an operating member.

What is claimed is:

1. A push switch configured to be mounted on a circuit board, comprising:

an insulating case, having a wall portion defining a recess which is opened to a first side;

a conductive member, including a first portion embedded into the wall portion, a second portion disposed in the recess as a fixed electrode and an anchor member embedded into the wall portion;

a movable electrode, disposed in the recess, and configured to be displaced between a first position in which the moveable electrode is contacted with the fixed electrode and a second position in which the movable electrode is spaced apart from the fixed electrode; and an operating member, configured to be moved at the first side with respect to the movable electrode by a pressing force exerted thereon, and to displace the movable electrode from the second position to the first position;

wherein the anchor member protrudes from the first portion of the conductive member toward the first side in a direction not parallel to the direction in which the operating member is moved.

2. The push switch according to claim 1, wherein the anchor member includes a first anchor portion having a first width dimension and a second anchor portion having a second width dimension greater than the first width dimension, and the first anchor portion is located closer to the first portion of the conductive member than the second anchor portion is.

3. The push switch according to claim 1, wherein the anchor member forms an integral structure with the first portion.

4. The push switch according to claim 3, wherein the anchor member protrudes from a side edge of the first portion.

5. The push switch according to claim 1, wherein the anchor member forms an integral structure with the second portion.

6. The push switch according to claim 5, wherein the anchor member protrudes from a side edge of the second portion.

7. The push switch according to claim 1, wherein the anchor member is provided on a section of the conductive member extended parallel to the circuit board in a state where the push switch is mounted on the circuit board.

8. The push switch according to claim 1, wherein the conductive member comprises a third portion exposed on a side surface of the case.

9. The push switch according to claim 1, wherein the conductive member comprises a third portion exposed on a surface of the case facing the circuit board.

* * * * *